US008757409B2

(12) United States Patent
Behar

(10) Patent No.: US 8,757,409 B2
(45) Date of Patent: Jun. 24, 2014

(54) REMOVABLE ATTACHMENT SYSTEM

(75) Inventor: Alain Behar, Suresnes (FR)

(73) Assignee: Aptar France SAS, Le Neubourg (FR)

( * ) Notice: Subject to any disclaimer, the term of this patent is extended or adjusted under 35 U.S.C. 154(b) by 189 days.

(21) Appl. No.: 13/321,725

(22) PCT Filed: Jul. 23, 2010

(86) PCT No.: PCT/FR2010/051560

§ 371 (c)(1),
(2), (4) Date: Nov. 21, 2011

(87) PCT Pub. No.: WO2011/015760

PCT Pub. Date: Feb. 10, 2011

(65) Prior Publication Data

US 2012/0068030 A1 Mar. 22, 2012

(30) Foreign Application Priority Data

Jul. 27, 2009 (FR) ..... 09 55249

(51) Int. Cl.
*B65D 45/00* (2006.01)

(52) U.S. Cl.
USPC ..... 215/274; 215/273; 215/272; 220/319; 220/315; 222/321.9; 222/321.7; 222/321.1; 222/153.09; 222/153.01

(58) Field of Classification Search
CPC ..... B05B 11/3043; B05B 11/3045; B05B 11/3046; B05B 11/3047; B05B 11/3049; B65D 39/04; B65D 41/0471; B65D 41/58; B65D 45/30; B65D 45/32; B65D 47/12; B65D 47/121; B65D 47/127; B65D 47/14; B65D 47/141; B65D 55/08; B65D 55/0845
USPC ..... 215/273–274, 276; 220/315, 319; 222/153.01, 153.09, 153.11, 321.1, 222/321.7, 321.9, 372, 383.1, 402.1, 542
See application file for complete search history.

(56) References Cited

U.S. PATENT DOCUMENTS

| | | | | |
|---|---|---|---|---|
| 2,723,773 | A * | 11/1955 | Greene | 215/29 |
| 3,447,725 | A * | 6/1969 | Armour | 222/486 |
| 3,893,582 | A * | 7/1975 | Kowalik | 215/221 |
| 3,938,715 | A * | 2/1976 | Bogert | 222/534 |
| 4,359,166 | A | 11/1982 | Dubach | |
| 4,773,553 | A * | 9/1988 | Van Brocklin | 215/272 |
| 5,299,703 | A * | 4/1994 | Cater | 215/274 |
| 5,562,219 | A | 10/1996 | de Pous et al. | |
| 6,189,741 | B1 * | 2/2001 | Behar | 222/321.7 |

(Continued)

FOREIGN PATENT DOCUMENTS

EP 0704251 A2 4/1996

*Primary Examiner* — Mickey Yu
*Assistant Examiner* — Brijesh V. Patel
(74) *Attorney, Agent, or Firm* — Sughrue Mion, PLLC

(57) ABSTRACT

A fastener system for releasably fastening a dispenser member on a reservoir neck, the system having a fastener ring including flexible axial tabs for fastening around the reservoir neck, the tabs separated by axial slots; and a locking sleeve engaged around the fastener ring to lock the tabs in engagement around the neck. The sleeve forms a plurality of locking sectors that engage the tabs to lock them around the neck and a plurality of non-locking sectors not in contact with the ring. The sleeve is movable about the ring between an assembled position and a disassembled position in which the locking sectors are situated at the slots so as to enable the tabs to deform in order to disengage from the neck.

16 Claims, 7 Drawing Sheets

(56) References Cited

U.S. PATENT DOCUMENTS

| | | | | |
|---|---|---|---|---|
| 7,757,902 | B2 * | 7/2010 | Bevans et al. | 222/321.9 |
| 2001/0037990 | A1 * | 11/2001 | Pous et al. | 215/272 |
| 2002/0096539 | A1 * | 7/2002 | Milian et al. | 222/153.11 |
| 2006/0273115 | A1 * | 12/2006 | De Pous | 222/321.9 |
| 2006/0283830 | A1 * | 12/2006 | Jourdin et al. | 215/273 |
| 2007/0068972 | A1 * | 3/2007 | Pleyer | 222/321.9 |
| 2009/0277930 | A1 * | 11/2009 | Carta | 222/153.01 |
| 2010/0264171 | A1 * | 10/2010 | Behar et al. | 222/321.1 |
| 2011/0024465 | A1 * | 2/2011 | Roosel et al. | 222/321.1 |
| 2011/0108579 | A1 * | 5/2011 | Martorell Pena et al. | 222/321.1 |
| 2011/0240679 | A1 * | 10/2011 | Langlos | 222/321.7 |
| 2012/0061422 | A1 * | 3/2012 | Beranger et al. | 222/321.1 |

* cited by examiner

REMOVABLE ATTACHMENT SYSTEM

CROSS REFERENCE TO RELATED APPLICATIONS

This application is a National Stage of International Application No. PCT/FR2010/051560 filed on Jul. 23, 2010, which claims priority from French Patent Application No. 09 55249, filed on Jul. 27, 2009, the contents of all of which are incorporated herein by reference in their entirety.

The present invention relates to a fastener system for fastening a dispenser member, such as a pump or a valve, on a neck of a fluid reservoir so as to constitute a fluid dispenser, the system comprising a fastener ring having both reception means for receiving the dispenser member, and fastener means for coming into engagement around the neck of the reservoir. The fastener means generally include flexible axial tabs that are separated by axial slots. The system also comprises a locking sleeve that is engaged around the ring so as to lock the tabs in engagement around the neck. Advantageous fields of application of the present invention are the fields of perfumery, cosmetics, or even pharmacy.

This type of fastener system using a fastener ring associated with a locking sleeve is already known in the prior art. In general, the fastener ring includes reception means, e.g. a housing, making it possible to receive the dispenser member that can, for example, include a projecting collar for engaging by snap-fastening in the housing of the ring. In addition to the reception means, the fastener ring also includes a fastener skirt of substantially cylindrical shape, said skirt forming the flexible tabs that define an inside wall that is provided with one or more fastener profiles for coming into engagement with the neck of the reservoir. Conventionally, the neck of the reservoir forms a projecting annular outer reinforcement below which the fastener profile(s) is/are engaged in the final assembled position. The function of the locking sleeve is to prevent the inner profile(s) of the tabs of the skirt from becoming disengaged from below the projecting outer reinforcement of the neck. In other words, the locking sleeve holds the fastener profile(s) of the ring captive against the neck of the reservoir. In order to enable the profile(s) of the skirt to pass beyond and below the projecting annular reinforcement of the neck, provision is made to form the skirt of the ring with longitudinal axial slots so as to divide the skirt into a plurality of tabs that are separated by slots. It is necessary for the skirt of the ring to be able to deform radially outwards while passing over the reinforcement of the neck. The function of the locking sleeve is to prevent the skirt of the ring from deforming radially outwards once the fastener profile(s) is/are engaged below the reinforcement of the neck.

In general, the final assembled position in which the locking sleeve prevents the ring from becoming disengaged from the neck is a permanent position, in the sense that it is no longer possible to remove the' locking sleeve from the ring so as to enable the ring to be removed from the neck. Consequently, in order to remove a dispenser unit using such a fastener system, it is necessary to destroy the sleeve, the ring, or the neck. The locking sleeve is held on strongly, such that its resistance to traction cannot be overcome by pulling axially thereon, without damaging or destroying it.

However, in some circumstances, it can turn out to be useful to disassemble the dispenser, i.e. to remove the dispenser unit from the reservoir. When the reservoir is for refilling once it has been emptied, a screw-fastener system is generally used. The ring and locking-sleeve fastener system turns out to be not very suitable, given that the sleeve is put into place on the ring in permanent manner. Disassembly can also turn out to be useful in order to recycle the dispenser by separating its various component materials. In theory, this is possible with the ring and locking-sleeve fastener system, but that requires one of the ring, the sleeve, or the neck to be destroyed, which operation is random and therefore difficult to industrialize.

An object of the present invention is to extend the range of suitability of the ring and locking-sleeve fastener system to applications in which it is necessary to remove the dispenser unit from the reservoir. Another object of the present invention is to make disassembly possible, without adding additional pieces to the dispenser. Another object is to be able to remove the fastener system from the neck in industrial manner by means of an operation that is simple and guaranteed. Easy disassembly by the consumer for the purpose of recycling is also desired. Providing manufacture, implementation, and assembly/disassembly that are simple and low cost are also objects of the present invention.

To achieve these objects, the present invention proposes that the locking sleeve forms a plurality of locking sectors for coming into engagement with the tabs so as to lock them around the neck, and a plurality of non-locking sectors not in contact with the ring, the sleeve being movable about the ring between an assembled position in which the locking sectors are in engagement with the tabs and the non-locking sectors are situated at the slots, and a disassembly position in which the locking sectors are situated at the slots and the non-locking sectors are situated at the tabs so as to enable the tabs to deform in order to disengage from the neck. Thus, the locking sleeve is movable merely by being turned, without any axial component, about the fastener ring, which ring remains completely stationary relative to the neck. It is the relative turning movement between the sleeve and the ring that makes it possible to pass from the assembled position to the disassembly position in which the fastener system may be removed once again from the neck.

In order to ensure that the locking sectors are positioned angularly at the same level as the corresponding flexible axial tabs, it is necessary to orientate the sleeve correctly relative to the ring. This may be performed while the fastener system is being assembled by indexing the relative position of the two parts. However, this complicates the assembly operation. In order to avoid this indexing operation, the present invention envisages a particularly ingenious disposition that resides in making the ring integrally with the sleeve, with the ring and the sleeve being interconnected via breakable bridges of material. Thus, the two parts are indexed relative to each other automatically by being molded as a single unit, and it is thus no longer necessary to worry about the angular position of the sleeve relative to the ring.

In a practical embodiment, the ring comprises: a notched skirt thereby forming tabs and slots; a plate for coming to bear against the neck, with a gasket possibly interposed therebetween; and a reception housing for receiving the dispenser member, advantageously by snap-fastening. In this configuration, the sleeve may initially be connected via bottom internal sharp edges of the locking sectors to the top external sharp edge of the skirt of the ring as a single unit, axially above each tab.

In some circumstances, it is preferable, or even essential, for it to be no longer possible to assemble the fastener system on the neck once it has been disassembled. The makes it possible in particular to avoid counterfeiting and fraud. In the invention, provision is made in the disassembly position for the locking sectors to penetrate, at least in part, into the slots, thereby preventing any return to the assembled position. Thus, the locking sectors perform an additional function of locking in the disassembly position, in the sense that the insertion of the locking sectors in the corresponding slots prevents the sleeve from subsequently turning freely on the ring. The locking sectors thus perform a catch or lock function on being received inside the slots, without any possibility of return.

In order to ensure that the sleeve turns on the ring, it is essential for the friction forces in turning between the ring and the neck to be greater than the friction forces in turning between the sleeve and the ring, at least when the locking sectors are in engagement with the tabs. Advantageously, the neck forms turn-prevention means so as to prevent the ring from turning freely on the neck. The turn-prevention means may be in various forms, and more particularly in the form of projecting or recessed profiles formed at any location of the neck that is likely to interfere with the ring. It is not necessary for the ring to be completely prevented from turning on the neck: it is only necessary for the ring to not turn freely on the neck, but on the contrary be limited by an abutment.

According to another characteristic of the invention, the sleeve, and more particularly the locking sectors, come(s) into contact with the ring only at the tabs. In this way, the friction and clamping forces between the sleeve and the ring are concentrated at the tabs.

In another advantageous aspect of the invention, the non-locking sectors are wider than the tabs. The tabs can thus be positioned more easily at the non-locking sectors.

In a practical embodiment, in the disassembly position, clearance preferably exists between a tab and its non-locking sector. Advantageously, the locking sectors are formed by lugs that project inwards from the sleeve from a substantially cylindrical inside wall. Advantageously, the non-locking sectors are formed by a portion of the sleeve that interconnects the locking sectors, such that the sleeve is continuous over its entire periphery. The non-locking sectors are thus constituted by material, and more particularly by a wall, but said wall is not in contact with the ring, so as to create clearance. In a variant, it is also possible to make non-locking sectors in the form of an absence of material, which results in a notch or a slot between the locking sectors. But preferably, the sleeve presents a cylindrical outside wall that is interrupted at the locking sectors that form recesses.

In another aspect of the invention, the fastener system may further include a covering hoop that is preferably made of metal, and that is engaged around the sleeve so as to mask it. The hoop may even perform a locking function, in particular when the sleeve is not continuous over its entire periphery (non-locking sectors formed by notches or slots).

The principle of the invention resides in unlocking the tabs merely by turning the locking sleeve. This principle is all the easier to implement when it requires no indexing between the sleeve and the ring, and when locking in the disassembly position is ensured without complicating the configuration of the system.

The invention is described more fully below with reference to the accompanying drawings, which show an embodiment of the invention by way of non-limiting example.

Figure 1:
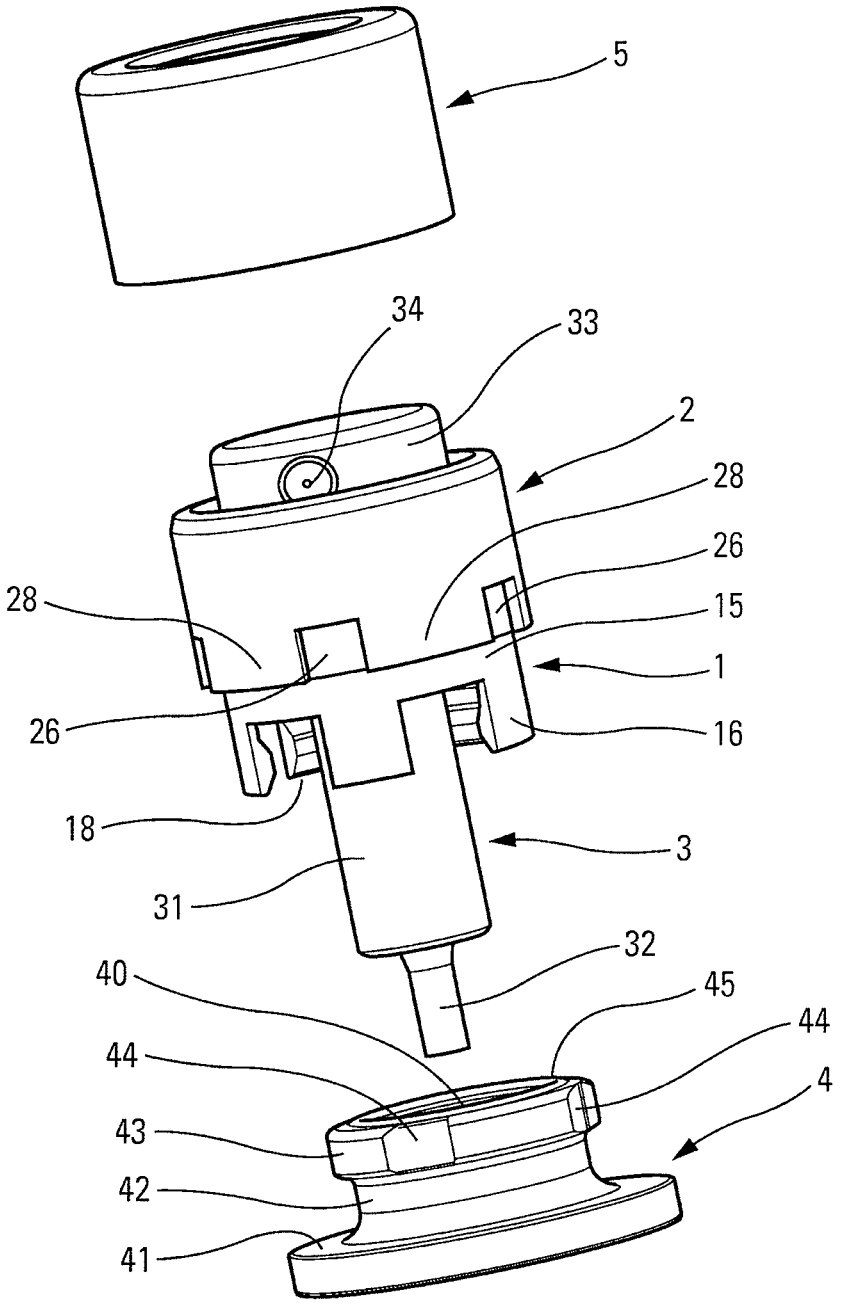
FIG. 1 is an exploded view of a fluid dispenser using a fastener system of the invention, in its pre-assembled position.

The fastener system of the invention comprises a fastener ring 1 associated with a locking sleeve 2. In FIG. 1, the fastener system is associated with a dispenser member 3 that may be a pump or a valve. The fastener system and the dispenser member constitute a dispenser unit that may possibly be completed by a covering hoop 5. The dispenser unit is for mounting in stationary and leaktight manner on a neck 4 of a fluid reservoir, thereby constituting a fluid dispenser such as that found in the fields of perfumery, cosmetics, or even pharmacy. The dispenser is a dispenser in which the dispenser member is actuated manually by means of one or more fingers.

The dispenser member 3 comprises a body 31 that is provided at its bottom end with a fluid inlet 32 that may optionally be provided with a dip tube (not shown). At its top end, the body 31 forms a collar (not shown) that projects radially outwards and that generally serves to fasten the dispenser member 3 in the fastener system of the invention, as described below. The dispenser member 3 further comprises an actuator rod (not shown) on which there is mounted a pusher 33 that advantageously forms a dispenser orifice 34. The pusher 33 is axially movable down and up against a return spring (not shown). On each actuation, fluid is dispensed, in optionally-metered manner, through the orifice 34. This is an entirely conventional design for a pump or a valve in the above-mentioned fields of application.

The neck 4 of the reservoir (not shown) includes an annular shoulder 41 that may be considered as already forming an integral part of the reservoir body. Starting from the shoulder 41, the neck forms a first constricted section 42 that is surmounted by an annular reinforcement 43 that projects outwards. The top end of the neck is formed by an annular edge 45 that defines the opening 40 of the reservoir. In the invention, the neck 4 is provided with turn-prevention means 44 that, in this embodiment, are formed at the annular reinforcement 43. However, it is also possible to form the turn-prevention means at another location of the neck 4, e.g. at the section 42, at the shoulder 41, or even at the annular edge 45. As described below, the function of the turn-prevention means 44 is to prevent the fastener ring 1 from turning freely on the neck 4. The turn-prevention means 44 in FIG. 1 are made in the form of notches or recesses, e.g. presenting a projecting sharp edge against which the fastener ring comes into abutment, thereby preventing it from turning freely. Advantageously, the projecting sharp edges make it possible to prevent turning in both directions. However, it is also possible to prevent turning in one direction only. Instead of the notches, it is also possible to make turn-prevention means in other forms, e.g. fluting on the projecting reinforcement 43, on the sector 42, on the shoulder 41, or even on the annular edge 45. It is also possible to form turn-prevention means in the form of one or more projecting profiles disposed on the neck. The turn-prevention means are preferably in the form of a recessed or projecting configuration in relief, but it is also possible to envisage the turn-prevention means being in the form of materials that make it possible to increase friction forces between the fastener ring 1 and the neck 4.

Figure 2:
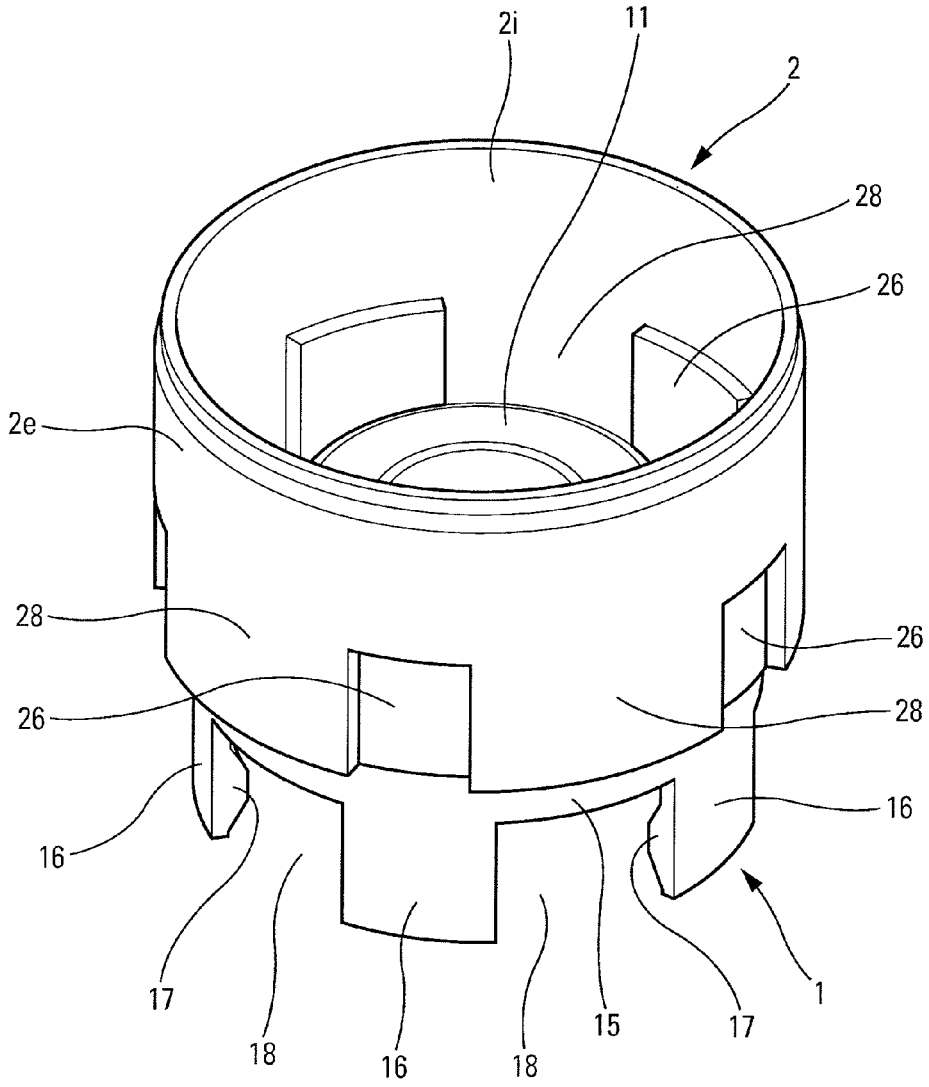
FIG. 2 is a larger-scale perspective view of the fastener system of the invention prior to assembly.
Figure 3:
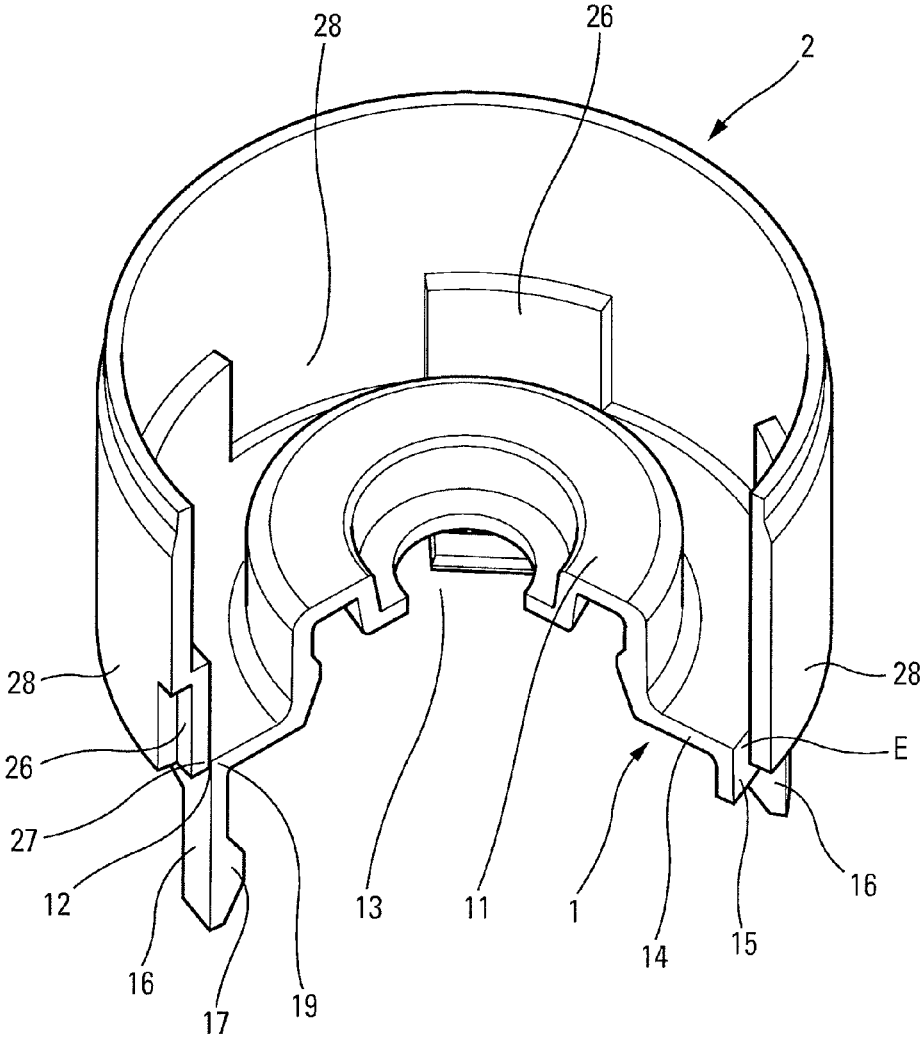
FIG. 3 is a view similar to the view in FIG. 2 with a portion of the fastener system cut away so as to allow the inside to be seen.

Reference is made below to FIGS. 1, 2, and 3 together in order to describe in detail the fastener system of the invention, and more particularly the fastener ring 1 and its associated locking sleeve 2.

Figure 4:
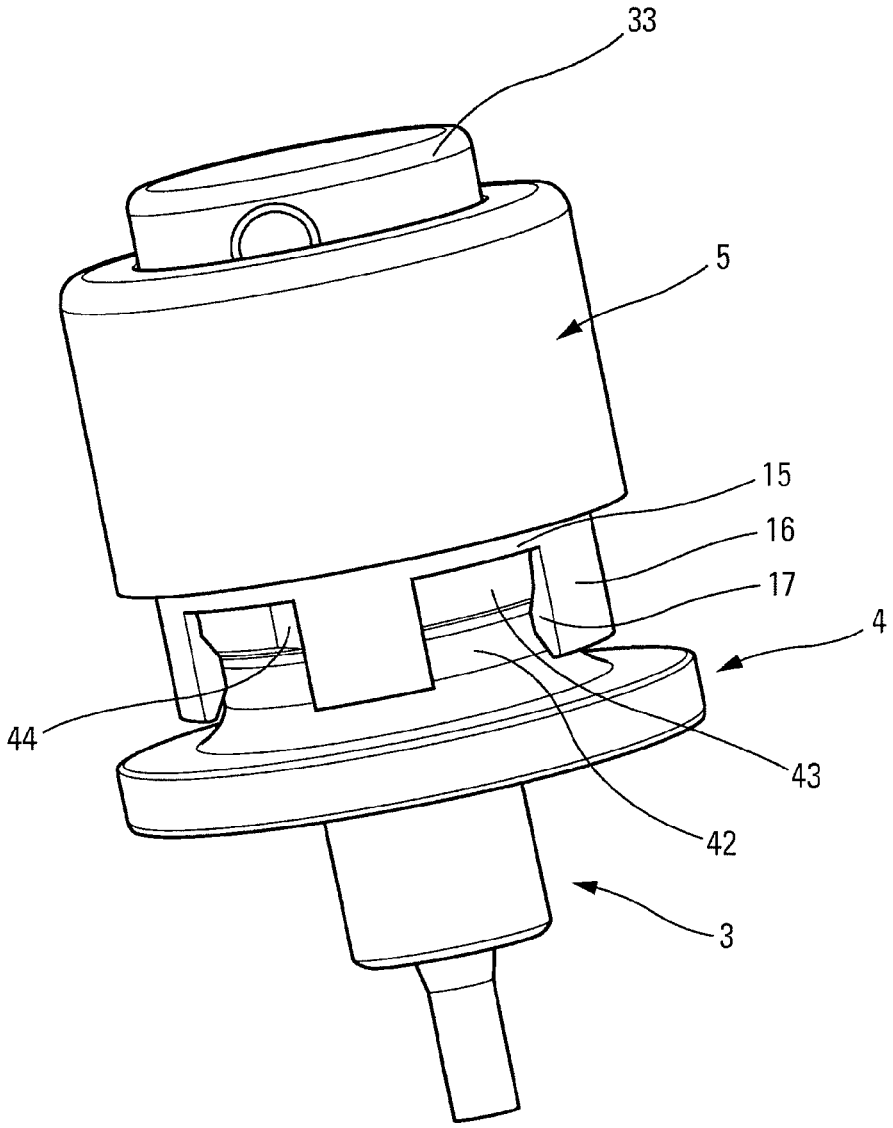
FIG. 4 is a perspective view of the FIG. 1 dispenser with the fastener system pre-assembled on the reservoir neck.

In entirely conventional manner, the fastener ring 1 includes reception means 11 that are designed to receive the dispenser member 3 in stationary and leaktight manner, e.g. by snap-fastening its projecting collar in a specially adapted housing that is formed by the reception means 11. Naturally, other reception techniques may be used for receiving the dispenser member 3 in stationary and leaktight manner in the fastener ring 1. At its center, the fastener ring forms an opening 13 through which the actuator rod of the dispenser member 3 may pass. At its outer periphery, the reception means form an annular plate 14 for coming to bear against the annular top edge 45 of the neck 4, with a neck gasket possibly interposed therebetween. The annular plate 14 thus mainly has a function of providing sealing between the fastener ring 1 and the neck 4 of the reservoir. At its outer periphery, the plate 14 is extended by a cylindrical skirt 15 that extends downwards. The skirt 15 is notched in such a manner as to define a plurality of axial tabs 16 that are separated by axial slots 18. This is clearly visible in FIG. 2. In this embodiment, the skirt 15 forms five flexible axial tabs 16 and five axial slots 18 that are distributed in regular manner over the periphery of the skirt 15. A function of the slots 18 is to impart a certain amount of flexibility to the axial tabs 16. In this way, they are slightly deformable, particularly in the radially-outward direction, so as to enable the fastener ring 1 to be assembled on the neck 4, as described below. Advantageously, the inside wall of the tabs 16 is formed with one or more fastener profiles 17 for coming to be housed below the annular reinforcement 43 at the constricted section 42. This is visible in FIG. 4. Advantageously, the slots 18 are wider than the tabs 16. The slots 18 open downwards and extend upwards into the proximity of the plate 14. In a variant that is not shown, it is possible to extend the skirt 16 upwards beyond the plate 14, so as to form a guide wall. This is an entirely conventional overall design for a fastener ring in the fields of perfumery, cosmetics, or even pharmacy.

The locking sleeve 2 presents a configuration that is substantially cylindrical. The sleeve defines an inside wall 2*i* and an outside wall 2*e* that are both substantially cylindrical: their cylindrical shape being interrupted only at a plurality of locking sectors 26 that project inwards relative to the inside wall 2*i*. It should also be observed that the outside wall 2*e* is also hollowed-out at the locking sectors 26, but it can also be envisaged to make the outside wall 2*e* completely cylindrical, i.e. filling in the recesses formed at the locking sectors 26. In this embodiment, the locking sectors 26 are five in number and are distributed in regular manner over the periphery of the sleeve 2, in corresponding manner to the tabs 16 of the skirt 15. The locking sectors 26 are separated by non-locking sectors 28 that form a portion of the sleeve and of the inside and outside walls 2*i* and 2*e*. In other words, the non-locking sectors 28 form an integral part of the main cylindrical portion of the sleeve 2. The locking sleeve 2 can thus be considered as a completely cylindrical part, except at the locking sectors 26 that are formed by zones that are offset radially inwards. The wall thickness at the locking sectors 26 may be identical to the wall thickness of the non-locking sectors 28. In a variant, when the outside wall 2*e* is completely cylindrical, the wall thickness of the locking sectors is greater than the wall thickness of the non-locking sectors 28. It should be observed that the sleeve 2 is continuous over its entire periphery at the locking and non-locking sectors 26 and 28. In a variant, it is also possible to form the non-locking sectors 28 in the form of windows or notches that can be likened to the slots 18. It is possible to notch, in part or completely, the non-locking sectors 28. The purpose of the locking sectors 26 is to define an inside diameter that is less than the diameter at the non-locking sectors 28. Thus, the inside wall of the locking sectors 26 can come into clamping contact around the fastener ring 1, and more particularly can come into contact with the skirt 15, whereas the non-locking sectors 28 do not come into contact with the ring. The locking sectors 26 can extend over the entire height of the sleeve 2, or over a smaller fraction only, as in the figures. However, it is preferable for the sectors 26 to extend over a bottom portion only of the sleeve, so as to perform an additional function of turn-prevention in the disassembly position, as described below.

Figure 5:
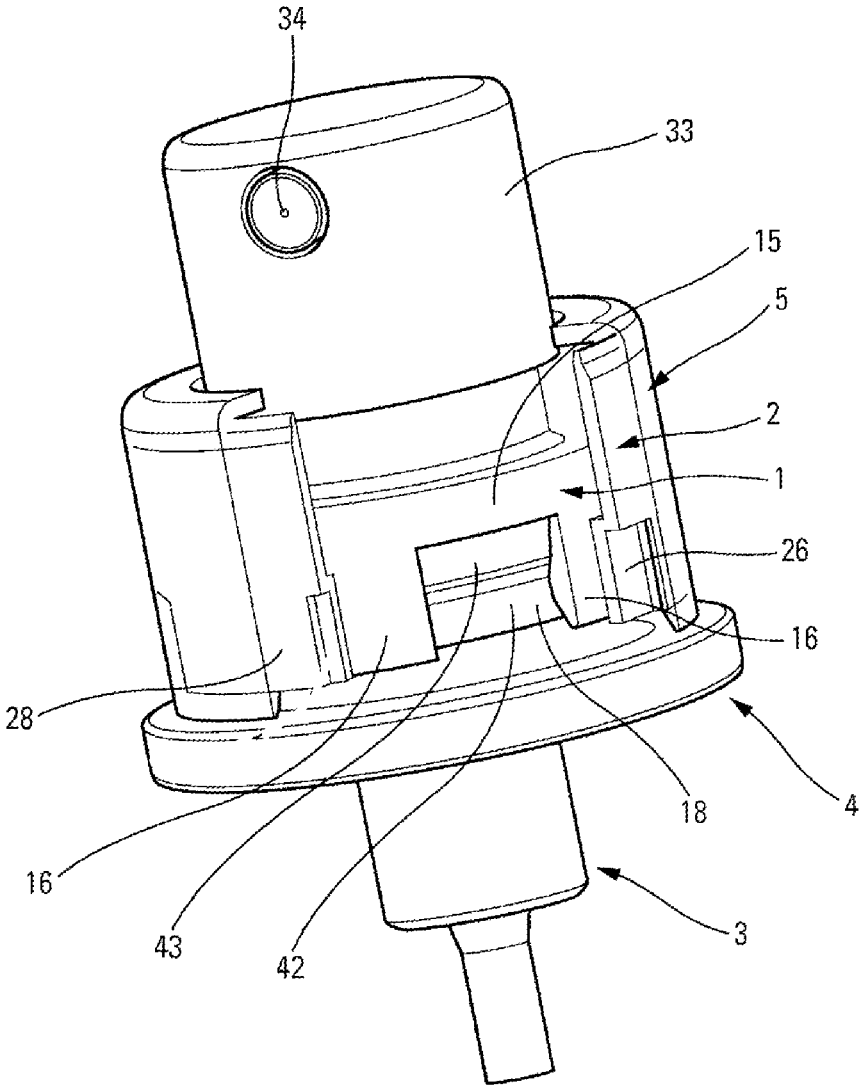
FIG. 5 is a view similar to the view in FIG. 4 with the fastener system in its final assembled position, with a cut-away portion so as to allow the inside to be seen.

The locking sleeve 2 is for engaging around the fastener ring 1, in such a manner as to lock the tabs 16 of the ring 1 around the neck 4. This is an entirely conventional function for a conventional locking sleeve. The distinctive feature of the present invention resides in the fact that the locking sleeve 2 comes into contact with the ring 1 at the locking sectors 26, whereas the non-locking sectors 28 do not come into contact. As described above, the fastener ring 1 is for mounting on the neck 4 in such a manner that the tabs 16 surround the neck 4, with the fastener profiles 17 being engaged below the annular reinforcement 43 at the constricted sector 42. This is visible in FIG. 4. However, given that the tabs 16 are flexible, they alone do not suffice to hold the fastener ring in stable and leaktight manner on the neck 4. It is thus necessary to lock the tabs 16 in position around the neck 4, and this is achieved by means of the locking sleeve 2, having locking sectors 26 that are engaged by friction and clamping around the tabs 16, as can be seen in FIG. 5. The fastener system is thus in its final assembled position. Naturally, it is necessary for the locking sectors to be positioned at the tabs 16 (one locking sector per tab). When the locking sleeve itself is sufficiently stiff, the locking function is performed entirely by the locking sectors. However, when the locking sleeve is not sufficiently stiff, as may occur when the non-locking sectors are constituted by notches or windows, it is thus necessary to use a covering hoop 5 that is engaged with friction around the locking sleeve 2, as can be seen in FIG. 5. When the sleeve itself is sufficiently stiff, the covering hoop 5 thus performs only an appearance function, masking the fastener ring 1 and the locking sleeve 2.

In the assembled position shown in FIG. 5, the dispenser may be actuated by the user by pressing axially on the pusher 33 in such a manner as to move it axially down and up. The engagement of the tabs 16 around the neck 4 where they are locked in position by the sleeve 2, provides proper fastening of the dispenser member 3 on the reservoir neck. Sealing is provided by pressing the plate 14 (or the neck gasket) against the top edge 45 of the neck.

Figure 6:
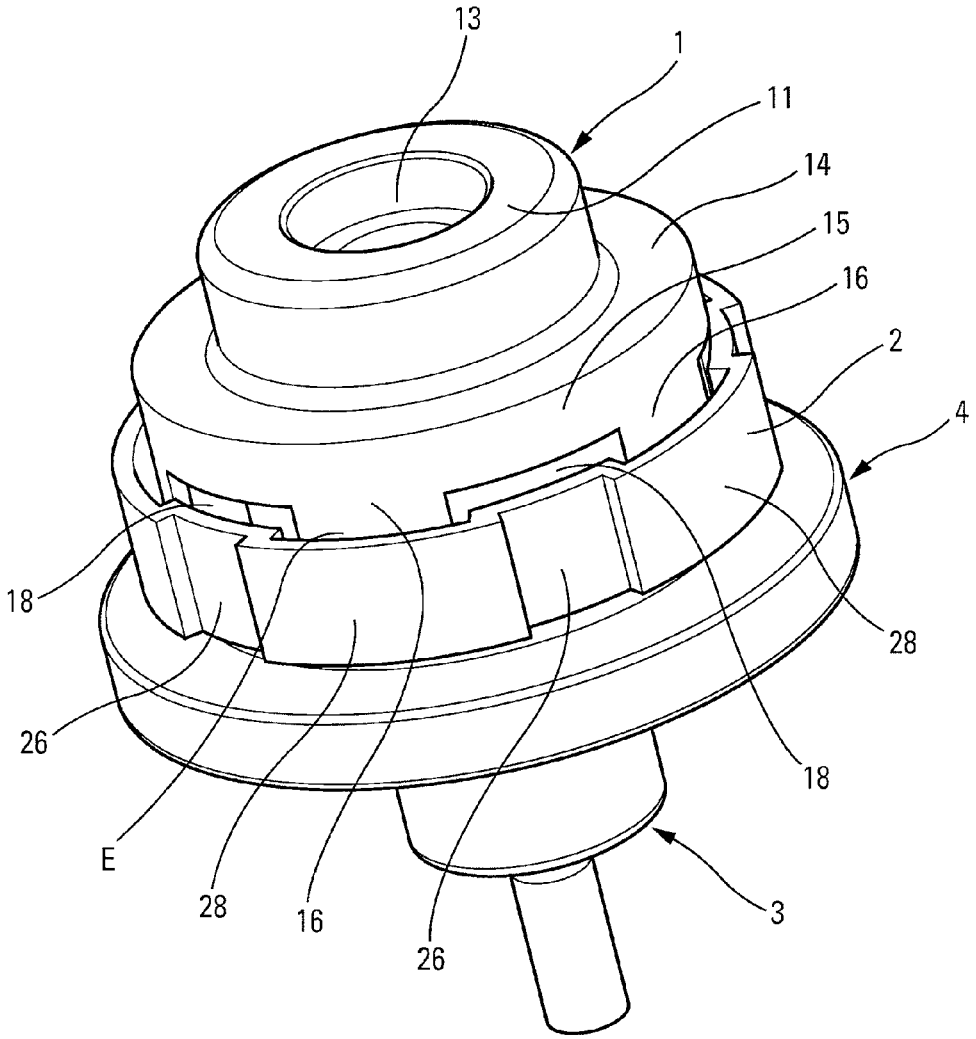
FIG. 6 is a larger-scale cut-away view with the pusher removed, in its disassembly position after turning the sleeve 2 about the ring 1.

In the invention, it is possible to turn the locking sleeve 2 relative to the fastener ring 1. Such turning may be performed by applying torque directly on the covering hoop 5 that is engaged in stationary manner around the sleeve 2. Specific fastener profiles may even be provided at the hoop 5 or at the sleeve 2 so as to increase the ability of the hoop 5 to hold the sleeve 2 against turning. The sleeve 2 may thus turn about the ring 1 until it reaches a disassembly position that is shown in FIG. 6. It can be seen that the locking sectors 26 are now positioned at the slots 18, while the tabs 16 are situated at the non-locking sectors 28. Given that the non-locking sectors 28 present an inside diameter that is greater than the outside diameter of the skirt 15 and of the tabs 16, there exists a clearance E that enables the tabs 16 to deform freely radially outwards so that they may be disengaged from below the annular reinforcement 43. When the non-locking sectors are made in the form of a notch or a window, the clearance is still greater since it is limited only by the inside wall of the covering hoop 5 that is engaged around the sleeve 2. In addition, it should be observed that the locking sectors 26 are engaged, in part, inside the slots 18. This is possible as a result of the height of the locking sectors 26 being less than the height of the slots 18. In this way, the locking sectors 26 are held captive in the slots 18, thereby preventing the sleeve 2 from turning freely about the ring 1 in the disassembly position. The engagement of the sectors 26 in the slots 18 also prevents the sleeve 2 from being removed by axial traction. The engagement of the sectors 26 inside the slots 18 thus guarantees that it is no longer possible to return to the assembled position from the disassembly position. This particular function of the locking sectors is particularly useful when it is desirable for it to be impossible to reassemble the dispenser unit on the reservoir.

Figure 7:
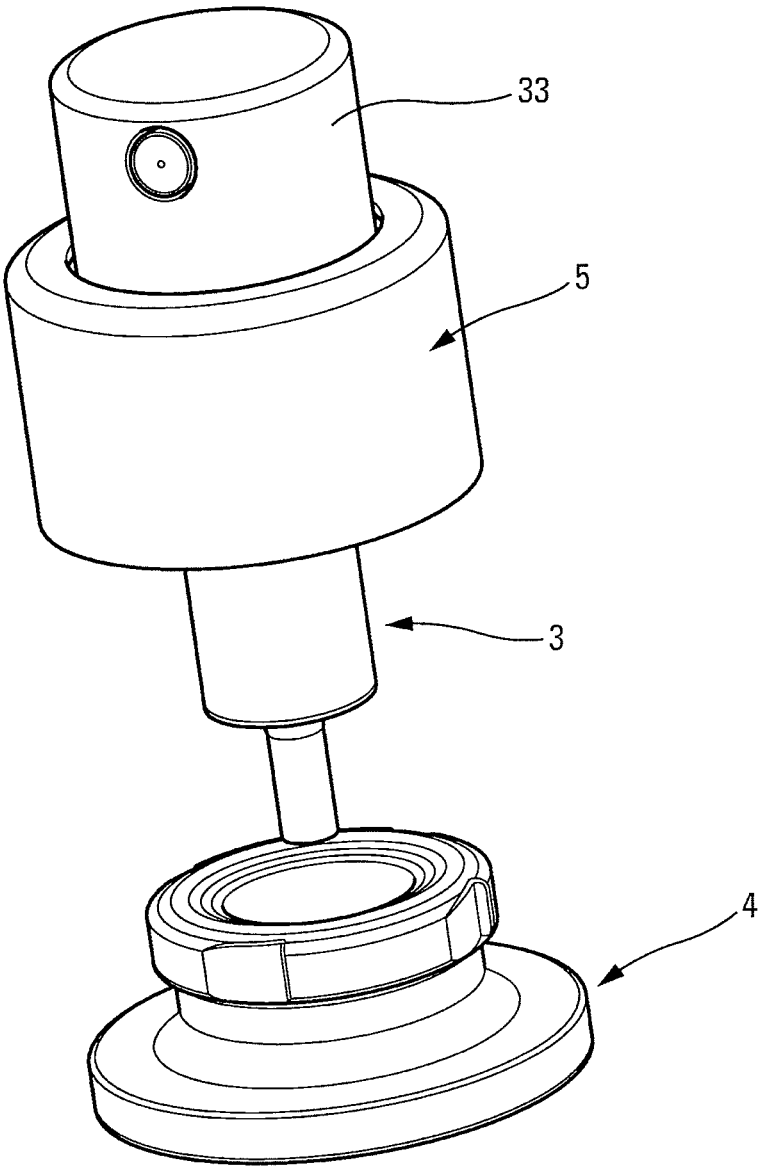
FIG. 7 is a perspective view of the dispenser in its disassembled state.

From the disassembly position shown in FIG. 6, it is thus possible to remove the dispenser unit, as shown in FIG. 7.

In order to enable the sleeve 2 to turn on the ring 1, it is necessary to prevent the ring 1 from turning on the neck 4. To do this, it is necessary for the friction forces between the ring and the neck to be greater than the friction forces between the ring 1 and the sleeve 2. This may be done by adjusting in appropriate manner the various friction forces, but preferably by using turn-prevention means 44 that are provided on the neck 4.

The fastener ring 1 and the locking sleeve 2 may be made separately, e.g. by injection molding plastics material. While the fastener system is being assembled, it is thus necessary to position the sleeve 2 angularly relative to the ring 1, so that the locking sectors 26 are positioned correctly relative to the tabs 16. This requires an indexation of the ring and of the sleeve, and an appropriate tool in order to position them angularly relative to each other. In order to avoid this indexing and positioning operation, the present invention envisages molding the ring 1 integrally with the sleeve 2. The two parts are thus connected together via breakable bridges of material 12 that are for breaking while the sleeve 2 is being engaged around the ring 1. By way of example, the breakable bridges of material 12 are situated at the bottom internal sharp edges 27 of the locking sectors 26, which bottom edges are in contact with the top external sharp edge 19 of the skirt 15, and which top edge also forms the peripheral edge of the plate 14. This is clearly visible in FIG. 3. In this way, the sleeve 2 is connected to the ring 1 via five breakable bridges of material that are situated at each of the locking sectors 26. The problem of mutually indexing the two parts no longer exists, given that the mutual orientation of the two parts stems directly from them being integrally molded together. Thus, on removal from the mold, and also in the final assembled position in which the locking sectors 26 are in contact with the tabs 16, the sleeve 2 is in contact with the ring only at the locking sectors 26. As can be seen in FIG. 3, the clearance E is already present between the non-locking sectors 28 and the skirt 15 on removal from the mold.

By means of the present invention, it is possible to disassemble a fastener system of the ring/sleeve type merely by turning the sleeve relative to the ring. In addition, it is not possible to reassemble the system on a neck once in the disassembly position.

The invention claimed is:

1. A fastener system for releasably fastening a dispenser member on a reservoir neck, the fastener system comprising:

the dispenser member a fastener ring including both reception means for receiving the dispenser member, and fastener means that are suitable for coming into engagement with the reservoir neck, the fastener means including a plurality of flexible axial tabs that are suitable for fastening around the reservoir neck, the axial tabs being separated by a plurality of axial slots; and a locking sleeve that is engaged around the fastener ring so as to lock the axial tabs in engagement around the reservoir neck;

the locking sleeve forms a plurality of locking sectors for coming into engagement with the axial tabs so as to lock the axial tabs around the reservoir neck, and a plurality of non-locking sectors not in contact with the fastener ring, the locking sleeve being movable about the fastener ring between an assembled position in which the locking sectors are in engagement with the axial tabs and the non-locking sectors are situated at the axial slots, and a disassembly position in which the locking sectors are situated at the axial slots and the non-locking sectors are situated at the axial tabs so as to enable the axial tabs to deform outwardly and disengage from the reservoir neck.

2. The fastener system according to claim 1, wherein, in the disassembly position, the locking sectors penetrate, at least in part, into the axial slots, thereby preventing any return to the assembled position.

3. The fastener system according to claim 1, wherein the friction forces in turning between the fastener ring and the reservoir neck are greater than the friction forces in turning between the locking sleeve and the fastener ring, at least when the locking sectors are in engagement with the axial tabs.

4. The fastener system according to claim 3, wherein the reservoir neck forms turn-prevention means so as to prevent the fastener ring from turning freely on the reservoir neck.

5. The fastener system according to claim 1, wherein the locking sleeve comes into contact with the fastener ring only at the axial tabs.

6. The fastener system according to claim 1, wherein the non-locking sectors are wider than the axial tabs.

7. The fastener system according to claim 1, wherein the fastener ring and the locking sleeve are made integrally as a single part, being connected together via breakable bridges of material.

8. The fastener system according to claim 1, wherein the locking sectors are connected to the fastener ring axially above the axial tabs.

9. A The fastener system according to claim 1, wherein, in the disassembly position, clearance (E) preferably exists between a tab and its non-locking sector.

10. The fastener system according to claim 1, wherein the locking sectors are formed by a plurality of lugs that project inwards from the locking sleeve from a cylindrical inside wall (2*i*).

11. The fastener system according to claim 1, wherein the non-locking sectors are formed by a portion of the locking sleeve that interconnects the locking sectors, such that the locking sleeve is continuous over its entire periphery.

12. The fastener system according to claim 1, wherein the locking sleeve presents a cylindrical outside wall (2*e*) that is interrupted at the locking sectors that form a plurality of recesses.

13. The fastener system according to claim 1, further including a covering hoop that is preferably made of metal, and that is engaged around the locking sleeve so as to mask it.

14. The fastener system according to claim 1, wherein the fastener ring comprises: a notched skirt thereby forming the axial tabs and the axial slots; a plate for coming to bear against the reservoir neck; and a reception housing for receiving the dispenser member, advantageously by snap-fastening.

15. The fastener system according to claim 14, wherein the locking sleeve is initially connected via bottom internal sharp edges of the locking sectors to the top external sharp edge of the notched skirt of the fastener ring as a single unit, axially above each axial tab.

16. The fastener system according to claim 1, wherein the dispenser member is a pump or a valve.

* * * * *